US005483930A

United States Patent [19]

Moriya et al.

[11] Patent Number: 5,483,930

[45] Date of Patent: Jan. 16, 1996

[54] VALVE TIMING CONTROL DEVICE

[75] Inventors: Yoshihito Moriya, Nagoya; Akihiko Takenaka, Anjo; Michio Adachi, Obu, all of Japan

[73] Assignees: Nippondenso Co., Ltd., Kariya; Toyota Jidosha Kabushiki Kaisha, Toyota, both of Japan

[21] Appl. No.: 386,908

[22] Filed: Feb. 8, 1995

Related U.S. Application Data

[63] Continuation of Ser. No. 245,555, May 18, 1994, abandoned.

[30] Foreign Application Priority Data

May 19, 1993 [JP] Japan ..... 5-116990

[51] Int. Cl.[6] ..... F01L 1/34

[52] U.S. Cl. ..... 123/90.17; 123/90.31; 74/568 R; 464/2

[58] Field of Search ..... 123/90.15, 90.17, 123/90.31; 74/567, 568 R; 464/1, 2, 160

[56] References Cited

U.S. PATENT DOCUMENTS

| | | | |
|---|---|---|---|
| 4,934,348 | 6/1990 | Yagi et al. | 123/90.17 |
| 5,012,773 | 5/1991 | Akasaki et al. | 123/90.17 |
| 5,012,774 | 5/1991 | Strauber et al. | 123/90.17 |
| 5,088,456 | 2/1992 | Suga . | |
| 5,170,756 | 12/1992 | Szodfridt | 123/90.17 |
| 5,243,935 | 9/1993 | Kano et al. | 123/90.17 |
| 5,301,639 | 4/1994 | Satou | 123/90.17 |
| 5,435,782 | 7/1995 | Tortul | 123/90.17 |

FOREIGN PATENT DOCUMENTS

| | | |
|---|---|---|
| 63-131808 | 6/1988 | Japan . |
| 91-3628 | 3/1991 | WIPO . |

*Primary Examiner*—Henry C. Yuen
*Assistant Examiner*—Weilun Lo
*Attorney, Agent, or Firm*—Cushman, Darby & Cushman

[57] ABSTRACT

In a valve timing control device, when a camshaft is retained relative to a timing pulley, a hydraulic piston is applied with a force which moves it in a direction toward an advancing-side hydraulic chamber (i.e., in the direction to vary a valve timing to a delaying side) owing to reaction of the driving torque of the camshaft. This force causes fluid to leak out of the advancing-side hydraulic chamber, and the hydraulic piston is liable to move toward this hydraulic chamber. However, fluid of an amount corresponding to an amount of this leakage is supplied to the advancing-side hydraulic chamber by way of a control valve. Also, discharge of fluid from a delaying-side hydraulic chamber via the control valve is stopped. Thus, the movement of the hydraulic piston toward the advancing-side hydraulic chamber when the hydraulic piston is retained at a desired position is prevented. Therefore, the hydraulic piston can be stably retained at the desired position, and a desired valve timing can be maintained.

8 Claims, 3 Drawing Sheets

VALVE TIMING CONTROL DEVICE

This application is a continuation of Ushida et al Application No. 08/245,555, filed May 18, 1994, now abandoned and is based on the priority patent application filed in Japan May 19, 1993, No. 5-116990, the content of of both of which is corporated herein by reference.

BACKGROUND OF THE INVENTION

The present invention relates to a valve timing control device for controlling the timing of opening of intake and exhaust valves.

As this type of valve timing control device, a valve timing control device for an internal combustion engine disclosed in Japanese Patent Unexamined Publication No. 63-131808 has been conventionally known.

This device includes a gear movably provided between a timing pulley and a camshaft in such a manner that the timing pulley and the camshaft are rotated relative to each other by moving the gear therebetween, so as to vary the timing of opening and closing of valves. Further, hydraulic chambers are formed on the front and rear sides of the gear, and hydraulic pressure supply means are provided for supplying hydraulic pressure to these two hydraulic chambers through a cam journal portion.

By controlling the hydraulic pressure supplied to the two hydraulic chambers by the above-mentioned hydraulic pressure supply means, the gear is moved in a desired direction or stopped/retained at a desired position between the cam pulley and the camshaft. Thus, the value timing is controlled to a desired timing in accordance with an operating condition.

In the above-described conventional technique, rotation of the timing pulley is transmitted to the camshaft through helical splines formed on the inner and outer peripheries of the gear. Consequently, reaction force of the driving torque of the camshaft is constantly applied to the gear, and the camshaft always tends to be delayed from rotation of the timing pulley due to the frictional force. Therefore, owing to the reaction force from the camshaft, the gear is applied with a force which moves the gear in a direction to vary the valve timing to a delaying side.

In order to control the value timing to a desired timing, the gear is retained at a desired position by controlling the hydraulic pressure supplied to the two hydraulic chambers. At this time, due to the above-mentioned force applied to the gear so as to vary the valve timing to the delaying side, the hydraulic pressure in the hydraulic chamber which receives this force (i.e., the advancing-side hydraulic chamber) is increased. Such an increase in the hydraulic pressure causes fluid to leak to the outside from the advancing-side hydraulic chamber, thereby decreasing an amount of fluid in the hydraulic chamber. Since the gear is moved due to such a decrease in the fluid amount, it is feared that the gear can not be retained at the desired position.

Although such a problem may arise when retaining the gear at the desired position, measures against this problem were not taken into consideration in the conventional technique described above.

SUMMARY OF THE INVENTION

It is an object of the present invention to provide a valve timing control device in which a gear can be stably retained at a desired position.

In order to achieve the foregoing object, this invention provides a valve timing control device comprising a cylindrical gear having splines formed on the inner and outer peripheries thereof, the splines formed on at least one of the inner and outer peripheries thereof being helical, the gear being engaged between a crankshaft-side member and a camshaft-side member so as to transmit rotation of the crankshaft-side member to the camshaft-side member, and gear driving means for moving the gear in the axial direction by a hydraulic pressure, including an advancing-side hydraulic chamber for rotating the camshaft-side member relative to the crankshaft-side member to an advancing side, and a delaying-side hydraulic chamber for rotating the camshaft-side member relative to the crankshaft-side member to a delaying side, wherein this device further includes fluid rate control means which supply fluid to the advancing-side hydraulic chamber and discharge fluid from the delaying-side hydraulic chamber when the camshaft-side member is rotated relative to the crankshaft-side member to the advancing side, and which supply fluid to the delaying-side hydraulic chamber and discharge fluid from the advancing-side hydraulic chamber when the camshaft-side member is rotated relative to the crankshaft-side member to the delaying side, and which supply fluid to fill both the hydraulic chambers when the camshaft-side member is retained at a desired position relative to the crankshaft-side member, the fluid rate control means supply fluid of a predetermined rate to the advancing-side hydraulic chamber and substantially stop discharging fluid from the delaying-side hydraulic chamber when the camshaft-side member is retained at the desired position relative to the crankshaft-side member.

With the above-described structure of the valve timing control device of the invention, the rate of fluid supplied to the advancing-side and delaying-side hydraulic chambers which constitute the gear driving means is controlled by the fluid rate control means.

When fluid is supplied to the advancing-side hydraulic chamber and fluid is discharged from the delaying-side hydraulic chamber by the fluid rate control means, the gear is ,moved in the axial direction due to a pressure difference between the hydraulic chambers, and the camshaft-side member is rotated relative to the crankshaft-side member to the advancing side. On the other hand, when fluid is supplied to the delaying-side hydraulic chamber and fluid is discharged from the advancing-side hydraulic chamber, the camshaft-side member is rotated relative to the crankshaft-side member to the delaying side. Further, when fluid is supplied to and filled in both the hydraulic chambers, the gear is retained at the position, and the camshaft-side member is retained at the position relative to the crankshaft-side member.

When the camshaft-side member is retained at the desired position relative to the crankshaft-side member, fluid of the predetermined rate is supplied to the advancing-side hydraulic chamber, and supplying fluid to and discharging fluid from the delaying-side hydraulic chamber is stopped by the fluid rate control means. When the driving-torque reaction force of the camshaft-side member causes an increase in the hydraulic pressure in the advancing-side hydraulic chamber and fluid leaks, the gear is liable to move toward the advancing-side hydraulic chamber. In such a case, however, the fluid amount in this chamber is maintained by supplying fluid of the predetermined rate to the advancing-side hydraulic chamber and stopping discharge of fluid from the delaying-side hydraulic chamber, and therefore, the movement of the gear can be decreased. In consequence, stability in retaining the gear at the desired position is improved by a large degree.

DETAILED DESCRIPTION OF THE PREFERRED EMBODIMENTS

One embodiment of a value timing control device to which the present invention is applied will be hereinafter described with reference to the attached drawings.

Figure 1:
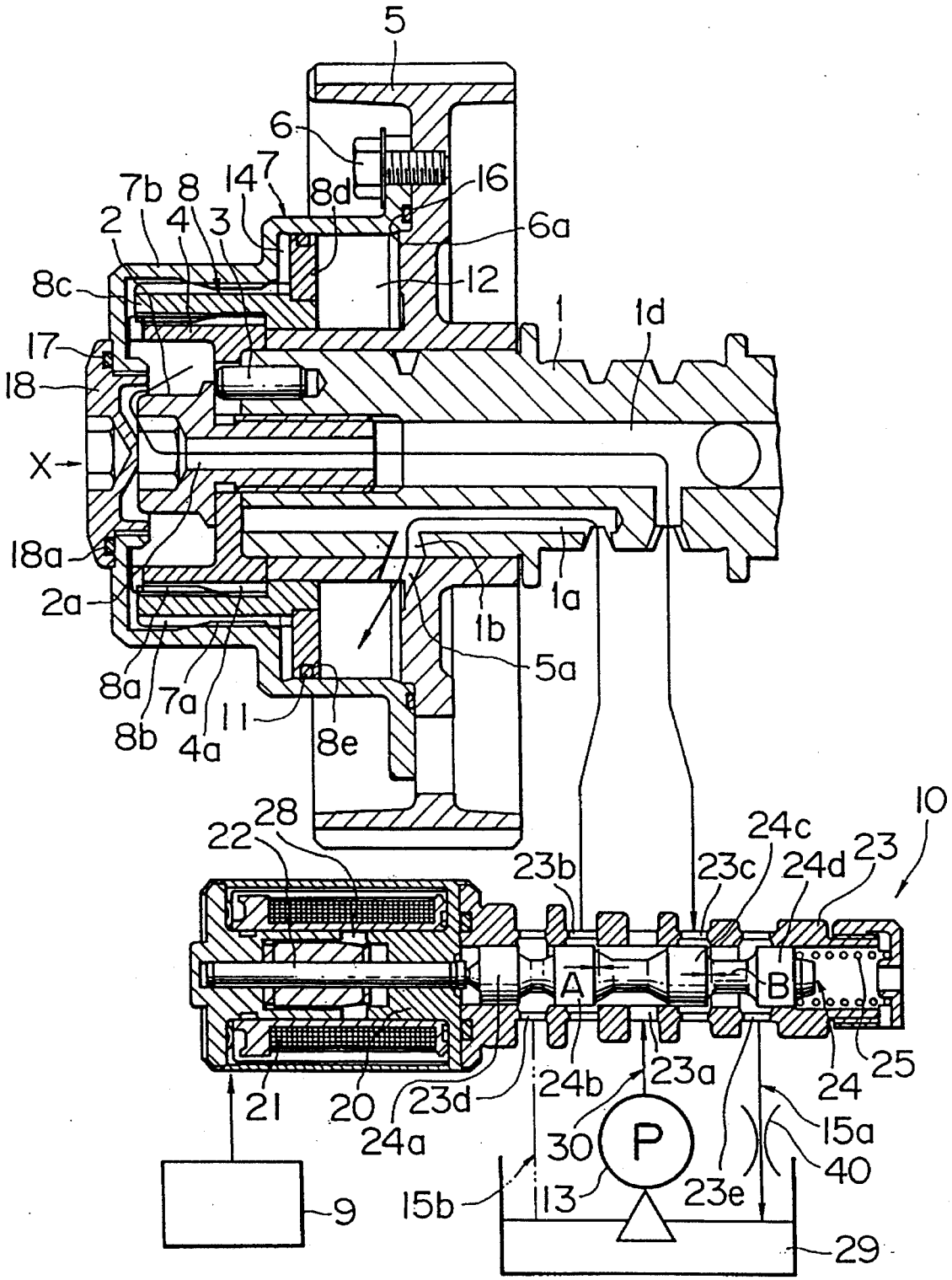
FIG. 1 is a cross-sectional view showing a valve timing control device according to the present invention in the most delayed condition.
Figure 2:
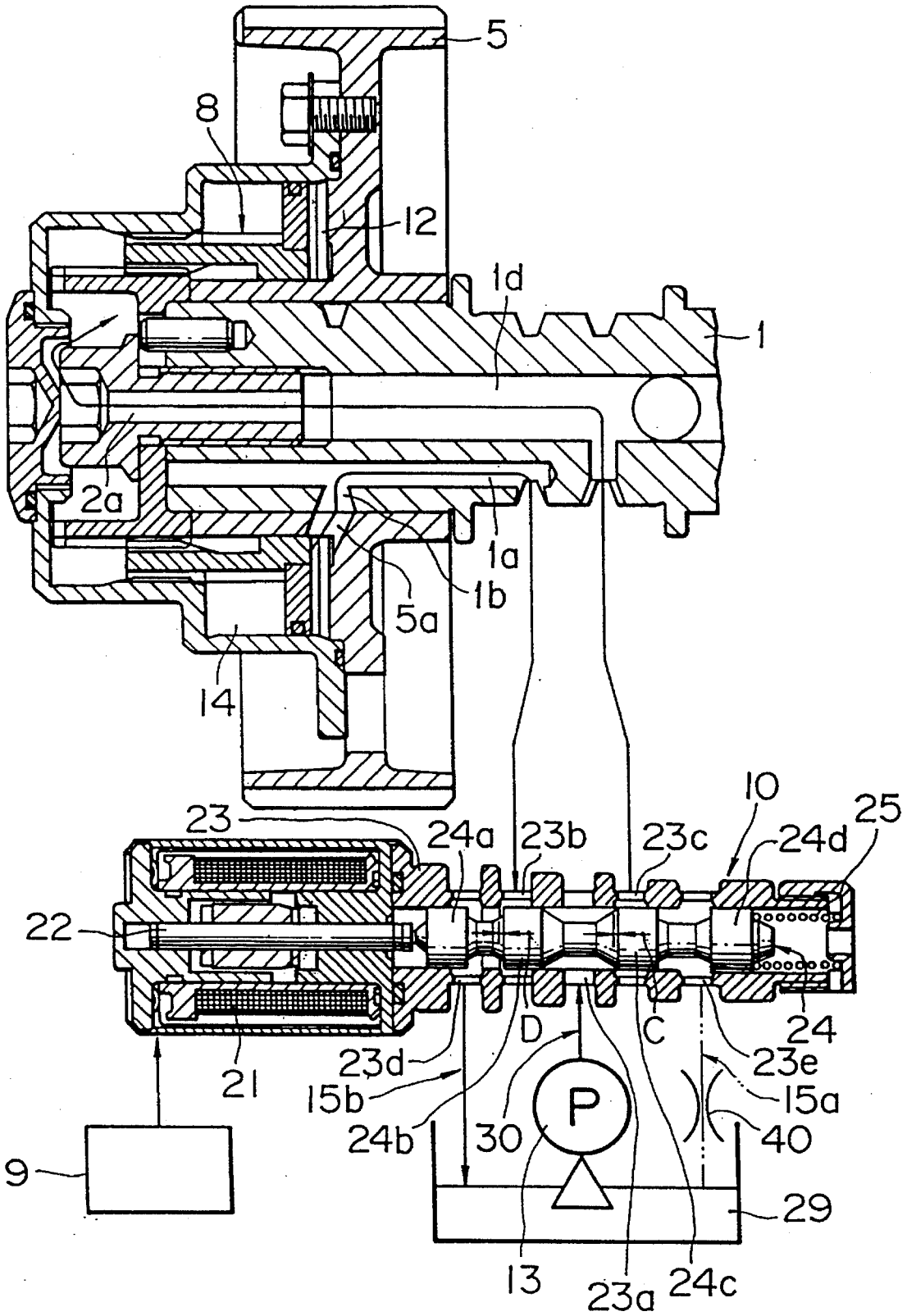
FIG. 2 is a cross-sectional view showing the valve timing control device according to the invention in the most advanced condition.
Figure 3:
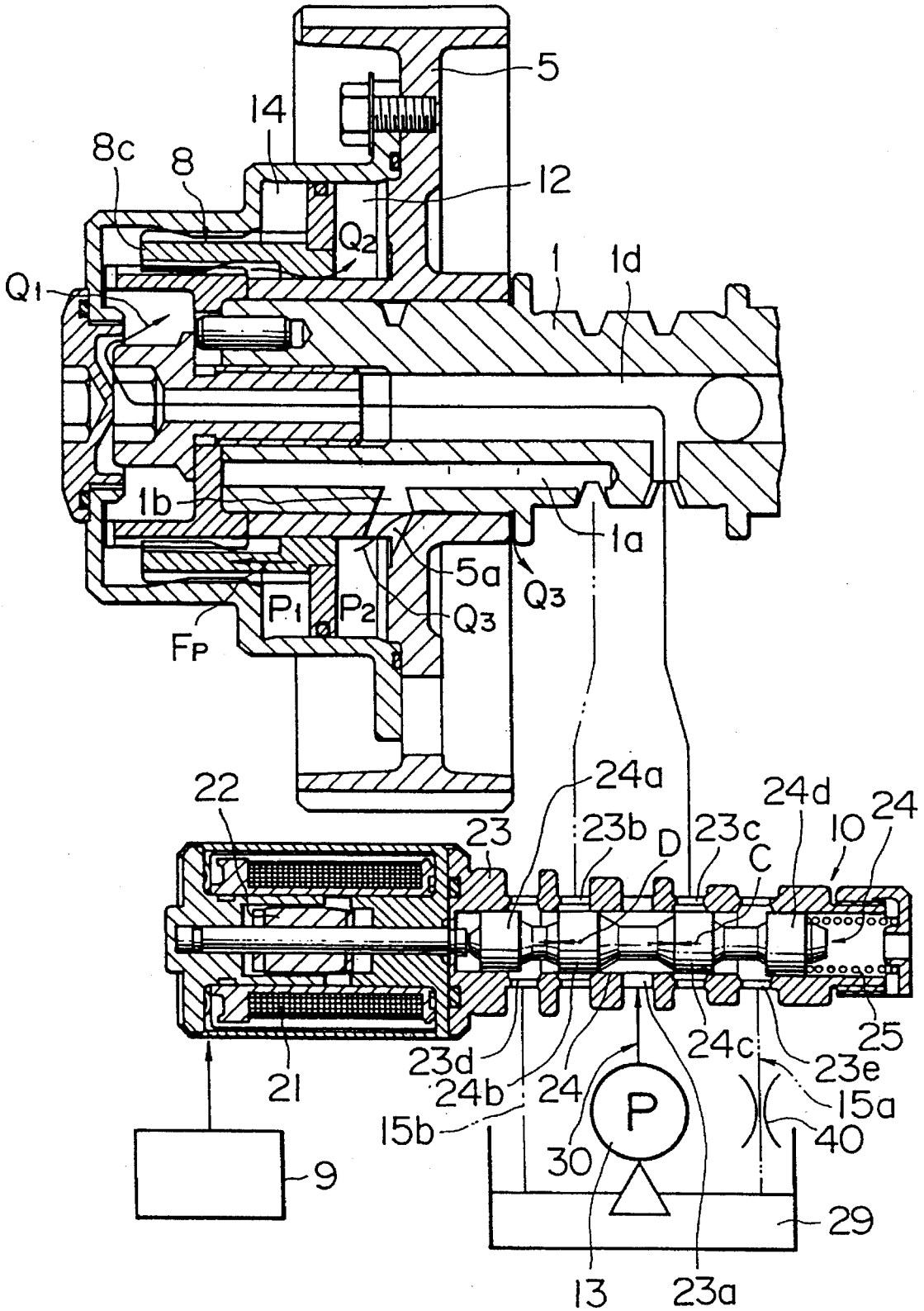
FIG. 3 is a cross-sectional view showing the valve timing control device according to the invention when a gear is retained at an intermediate position.

FIGS. 1, 2 and 3 are cross-sectional views of the valve timing control device.

By means of a timing belt for transmitting motive power of a crankshaft not shown, a timing pulley 5 which is a-member on the crankshaft side is rotated, and a camshaft 1 is rotated in synchronism with this rotation. The timing pulley 5 and the camshaft 1 are rotated clockwise as viewed in a direction indicated by the arrow X in FIG. 1 (this clockwise direction will be hereinafter referred to as the advancing direction).

A camshaft sleeve 4 which is a generally cylindrical member on the camshaft side is fixed on an end portion of the camshaft 1 by a pin 3 and a bolt 2 so that the camshaft sleeve 4 is rotated integrally with the camshaft 1. External helical splines 4*a* are formed on a part of the outer peripheral surface of the camshaft sleeve 4.

The timing pulley 5 is interposed between the camshaft 1 and the camshaft sleeve 4 and prevented from moving in the axial direction, and also, the timing pulley 5 is supported rotatably relative to the camshaft 1. A stepped cylindrical sprocket sleeve 7 is fixed on the timing pulley 5 by a bolt 6. A groove 6*a* is formed in the surface of the sprocket sleeve 7 where it is attached to the timing pulley 5, and an O-ring 16 for maintaining liquid tightness is provided in the groove 6*a*.

A smaller-diameter portion 7*b* of the sprocket sleeve 7 is opposed to the camshaft sleeve 4 through a predetermined gap in the radial direction. Internal helical splines 7*a* are formed on a part of the inner peripheral surface of the smaller-diameter portion 7*b*. The internal helical splines 7*a* have a helix angle in a direction opposite to that of a helix angle of the foregoing external helical splines 4*a*. Either the external helical splines 4*a* or the internal helical splines 7*a* may be straight, splines with a helix angle of zero extending in the axial direction.

A hydraulic piston 8 which is a generally cylindrical gear movable in the axial direction of the camshaft 1, is inserted in the foregoing radial gap between the camshaft sleeve 4 and the smaller-diameter portion 7*b* of the sprocket sleeve 7.

The hydraulic piston 8 comprises a cylindrical portion 8*c* and a disk portion 8*d* having a hole which is press-fitted on an end portion of the cylindrical portion 8*c*.

The cylindrical portion 8*c* is slidably fitted on the timing pulley 5. Internal helical splines 8*a* engaged with the external helical splines 4*a* of the camshaft sleeve 4 are formed on a part of the inner peripheral surface of the cylindrical portion 8*c*. Also, external helical splines 8*b* engaged with the internal helical splines 7*a* of the sprocket sleeve 7 are formed on a part of the outer surface of the cylindrical portion 8*c*. Engagement between the above-mentioned splines causes rotation of the timing pulley 5 to be transmitted to the camshaft 1 by way of the sprocket sleeve 7, the hydraulic piston 8 and the camshaft sleeve 4.

In this embodiment, helix angles of the foregoing helical splines are determined in such a manner that when the hydraulic piston 8 is moved to the left in FIG. 1, the valve timing is varied to a delaying side.

A groove 8*e* is formed in the outer peripheral end of the disk portion 8*d* of the hydraulic piston 8 which is opposed to the inner peripheral surface of the sprocket sleeve 7, and a piston ring 11 for maintaining liquid tightness is provided in the groove 8*e*.

The inner space defined between the timing pulley 5 and the sprocket sleeve 7 is divided by this hydraulic piston 8 into two sections, i.e., an advancing-side hydraulic chamber 14 on the left side of the hydraulic piston 8 in FIG. 1 and a delaying-side hydraulic chamber 12 on the right side.

A bolt 18 is attached to a hole formed in the left end portion of the sprocket sleeve 7 in the figure. A groove 18*a* is formed in the bolt 18, and an O-ring 17 for maintaining liquid tightness is provided in the groove 18*a*.

A hydraulic passage 2*a* is formed in the bolt 2 fixed on the camshaft 1 to extend through the bolt 2 in the axial direction. One end of the hydraulic passage 2*a* is opened to the advancing-side hydraulic chamber 14. The other end of this hydraulic passage 2*a* is connected to a hydraulic passage 1*d* formed in the axial center portion of the camshaft 1. Thus, the hydraulic passage 1*d* communicates with the advancing-side hydraulic chamber 14 via the hydraulic passage 2*a*.

On the other hand, another hydraulic passage 1*a* is formed in the camshaft 1 in addition to the foregoing hydraulic passage 1*d*. This hydraulic passage 1*a* is connected to an annular groove 1*b* formed on the camshaft 1. Then, the annular groove 1*b* communicates with a hydraulic passage 5*a* formed in the timing pulley 5. This hydraulic passage 5*a* is opened to the delaying-side hydraulic chamber 12, and thus, the hydraulic passage 1*a* communicates with the delaying-side hydraulic chamber 12 by way of the annular groove 1*b* and the hydraulic passage 5*a*.

The two hydraulic passages 1*a*, 1*d* formed in the camshaft 1 described above are connected to a control valve 10. A hydraulic supply passage 30 for supplying fluid of a fluid reservoir 29 which is pressurized and delivered by a fluid pump 13, and two hydraulic release passages 15*a*, 15*b* for returning fluid to the fluid reservoir 29, are also connected to the control valve 10. Further, the hydraulic release passage 15*a* is provided with a throttle 40 for restricting a rate of fluid passed through the passage 15*a*.

The structure of the control valve 10 will now be described.

A coil portion 21 and a rod-like moving core 22 are provided in a yoke 20 of a generally cylindrical shape which is made of a magnetic material, and the moving core 22 is slidable in the yoke 20.

A cylindrical sleeve 23 is attached to an end portion of the yoke 20. A plurality of openings 23*a*, 23*b*, 23*c*, 23*d*, 23*e* are formed in predetermined portions of the wall surface of the sleeve 23 and connected to a plurality of passages through which the above-mentioned fluid is passed. More specifically, the opening 23*a* is connected to the hydraulic supply passage 30, the opening 23*b* is connected to the hydraulic passage 1*a*, the opening 23*c* is connected to the hydraulic passage 1*d*, the opening 23*d* is connected to the hydraulic release passage 15*b*, and the opening 23*e* is connected to the hydraulic release passage 15*a*.

A slidable spool 24 is provided in the sleeve 23. This spool 24 comprises larger-diameter portions 24*a*, 24*b*, 24*c*, 24*d* having substantially the same diameter as an inner diameter of the sleeve 23, and smaller-diameter portions for connecting these larger-diameter portions. One end of the spool 24 abuts against the moving core 22, and the other end of the spool 24 abuts against a spring 25 received in the sleeve 23. Thus, the spool 24 and the moving core 22 are urged in the left direction in FIG. 1 by the spring 25.

The spool 24 is moved in proportion with a value of electric current supplied to the coil portion 21. More specifically, when an electric current is supplied to the coil portion 21, an attraction force is generated in a gap 28 between the yoke 20 and the moving core 22. This attraction force causes the moving core 22 and the spool 24 to be moved in the right direction in FIG. 1 against the biasing force of the spring 25. When the supply of electric current to the coil portion 21 is stopped, the moving core 22 and the spool 24 are moved in the left direction by the biasing force of the spring 25 to be returned to the positions shown in FIG. 1.

The value of electric current supplied to the coil portion 21 is set to be zero in the state shown in FIG. 1 and to be the predetermined maximum value in the state shown in FIG. 2. This current supply value is controlled by a control circuit 9.

The spool 24 and the sleeve 23 of the control valve 10 are arranged in the following manner: In the state of FIG. 1 (i.e., when the current supply is zero), the right end portion of the larger-diameter portion 24*b* of the spool 24 causes the opening 23*b* to be open by a predetermined clearance A whereas the right end portion of the larger-diameter portion 24*c* causes the opening 23*c* to be open by a predetermined clearance B.

On the other hand, in the state of FIG. 2 (i.e., when the current supply has the predetermined maximum value), the left end portion of the larger-diameter portion 24*b* of the spool 24 causes the opening 23*b* to be open by a predetermined clearance D whereas the left end portion of the larger-diameter portion 24*c* causes the opening 23*c* to be open by a predetermined clearance C. It should be noted that the clearances C and D are determined to be C>D.

When the spool 24 is moved in the sleeve 23, the openings 23*a* to 23*e* are selectively opened for communication and closed by the larger-diameter portions 24*a* to 24*d* of the spool 24. Thus, state of communication between the hydraulic passages 1*a*, 1*d* and the hydraulic supply passage 30 and the hydraulic release passages 15*a*, 15*b* is changed to supply fluid to or discharge fluid from the advancing-side hydraulic chamber 14 and the delaying-side hydraulic chamber 12. In consequence, hydraulic pressures applied to both sides of the hydraulic piston 8 vary so that the hydraulic piston 8 is moved in the axial direction or retained at a predetermined position.

The operation of this embodiment will be described below.

When no electric current is supplied to the coil portion 21 by the control circuit 9, the spool 24 is moved in the sleeve 23 to the position shown in FIG. 1.

Then, the opening 23*a* communicates with the opening 23*b*, and also, the opening 23*c* communicates with the opening 23*e*, so that the hydraulic supply passage 30 is connected to the hydraulic passage 1*a* while the hydraulic release passage 15*a* is connected to the hydraulic passage 1*d*. Therefore, fluid is supplied to the delaying-side hydraulic chamber 12 whereas fluid is discharged from the advancing-side hydraulic chamber 14.

Thus, the hydraulic pressure in the delaying-side hydraulic chamber 12 becomes higher than that in the advancing-side hydraulic chamber 14. As a result, the hydraulic piston 8 is moved in the left direction in FIG. 1, and the camshaft 1 is rotated relative to the timing pulley 5 to be delayed from it, thereby varying the valve timing to the delaying side. In FIG. 1, the hydraulic piston 8 is moved to the leftmost position by the hydraulic pressure, and the camshaft 1 is in the most delayed condition.

On the other hand, when the predetermined maximum electric current is supplied to the coil portion 21 by the control circuit 9, the spool 24 is moved in the sleeve 23 to the position shown in FIG. 2.

Then, the opening 23*a* communicates with the opening 23*c*, and also, the opening 23*d* communicates with the opening 23*b*, so that the hydraulic supply passage 30 is connected to the hydraulic passage 1*d* while the hydraulic release passage 15*b* is connected to the hydraulic passage 1*a*. Therefore, fluid is supplied to the advancing-side hydraulic chamber 14 whereas fluid is discharged from the delaying-side hydraulic chamber 12.

Thus, the hydraulic pressure in the advancing-side hydraulic chamber 14 becomes higher than that in the delaying-side hydraulic chamber 12. As a result, the hydraulic piston 8 is moved in the right direction in FIG. 2, and the camshaft 1 is rotated relative to the timing pulley 5 to advance from it, thereby varying the valve timing to the advancing side. In FIG. 2, the hydraulic piston 8 is moved to the rightmost position by the hydraulic pressure, and the camshaft 1 is in the most advanced condition.

When a predetermined electric current is supplied to the coil portion 21 by the control circuit 9, the attraction force which attracts the moving core 22 and the biasing force of the spring 25 are balanced, and the spool 24 is retained at a predetermined position shown in FIG. 3 (hereinafter referred to as the intermediate position) in the sleeve 23.

Then, the larger-diameter portion 24*b* closes the opening 23*b*, and also, the larger-diameter portion 24*c* closes the opening 23*c*, to thereby stop supplying fluid to and discharging fluid from the two hydraulic chambers 12, 14. Thus, the hydraulic piston 8 is retained in the position at this time.

In this embodiment, as described before, the helix angles of the helical splines of the hydraulic piston 8 are designed in such a manner that when the hydraulic piston 8 is moved to the left, the valve timing is varied to the delaying side. Consequently, due to reaction of the driving torque of the camshaft 1, the hydraulic piston 8 is applied with a force which moves the hydraulic piston 8 in the direction to vary the valve timing to the delaying side, i.e., in the direction toward the advancing-side hydraulic chamber 14.

When the camshaft 1 is rotated relative to the timing pulley 5 toward the delaying side (for example, from the state of FIG. 2 to the state of FIG. 1), the foregoing reaction force of the driving torque is added to the hydraulic pressure difference between the two hydraulic chambers. If the driving torque of the camshaft 1 is changed, the moving speed of the hydraulic piston 8 is instantaneously increased. At this time, fluid supply to the delaying-side hydraulic chamber 12 can not follow immediately, and intermittent negative pressures are generated in the hydraulic chamber, thereby producing shock noises in the helical spline portion in some cases.

In this embodiment, the above-described problem of the conventional technique is solved in the following manner.

As described above, when the camshaft 1 is rotated relative to the timing pulley 5 to the delaying side, an amount of fluid discharged from the advancing-side hydraulic chamber 14 per unit time is restricted by the throttle 40 provided in the hydraulic release passage 15*a*. Then, the moving speed of the hydraulic piston 8 toward the advancing-side hydraulic chamber 14 (in the left direction of the figure) is restricted. As a result, a higher hydraulic pressure than the hydraulic pressure applied to the advancing-side hydraulic chamber 14 can be constantly applied to the delaying-side hydraulic chamber 12, and it is possible to prevent momentary shortage of fluid supply to the delaying-side hydraulic chamber 12 when the moving speed of the hydraulic piston 8 is instantaneously increased. Therefore, shock noises in,the helical spline portion can be prevented, and also, the durability can be improved.

In the foregoing embodiment, the amount of fluid discharged from the advancing-side hydraulic chamber 14 per unit time is restricted by providing the throttle 40 in the hydraulic release passage 15*a*. However, by forming the spool 24 or the sleeve 23 in such a manner that the clearance B shown in FIG. 1 is smaller, the rate of fluid discharged from the advancing-side hydraulic chamber 14 may be restricted. Further, this rate may be restricted by decreasing the opening area of the opening 23*e*.

This embodiment may be designed in such a manner that when the moving speed of the hydraulic piston 8 toward the advancing-side hydraulic chamber 14 is increased by the reaction force of the driving torque of the camshaft 1 and the fluid supply to the delaying-side hydraulic chamber 12 is insufficient (e.g., when a rate of fluid discharged from the fluid pump 13 is decreased), the flow resistance is increased for restricting the rate of fluid discharged from the advancing-side hydraulic chamber 14 so as to prevent vibration of the hydraulic piston 8, and that when the fluid supply to the delaying-side hydraulic chamber 12 is sufficient, the flow resistance is decreased for increasing the rate of fluid discharged from the advancing-side hydraulic chamber 14 so as to ensure the response of the valve timing.

When the spool 24 is retained at the intermediate position shown in FIG. 3, the hydraulic piston 8 would stay still because there is neither inflow nor outflow from the hydraulic passages, as described above. However, the hydraulic piston 8 is constantly applied with the reaction force of the driving torque in the left direction of the figure in the foregoing manner. Consequently, the hydraulic pressure in the advancing-side hydraulic chamber 14 is a positive pressure higher than the hydraulic pressure in the delaying-side hydraulic chamber 12. Further, since component parts of the valve timing control device are mainly constituted of rotary members, as described before, fluid leaks from rotary sliding portions of these component parts.

In this case, when the hydraulic pressure in the advancing-side hydraulic chamber 14 is higher than that in the delaying-side hydraulic chamber 12, fluid leaks to the delaying-side hydraulic chamber 12 from rotary sliding portions of the cylindrical portion 8*c* of the hydraulic piston 8 and the timing pulley 5. If, depending upon an amount of this fluid leakage, the hydraulic pressure in the delaying-side hydraulic chamber 12 is higher than the atmospheric pressure, fluid in the delaying-side hydraulic chamber 12 leaks to the outside from a rotary sliding portion of the timing pulley 5 relative to the camshaft 1 by way of the hydraulic passage 5*a*. As a result, the hydraulic piston 8 is gradually moved in the left direction, and the hydraulic piston 8 can not be retained at a desired position in some cases.

To solve the above-described problems is the most significant characteristic of the present invention, which will be described below.

In order to solve the above-described problems, the hydraulic piston 8 is stopped still by establishing the following expressions 1 and 2:

$$FP=(P1-P2)\times W \quad (1)$$

$$Q1=Q2=Q3 \quad (2)$$

wherein P1 represents the hydraulic pressure in the advancing-side hydraulic chamber 14, P2 represents the hydraulic pressure in the delaying-side hydraulic chamber 12, W represents a pressure receiving area of the hydraulic piston 8, FP represents the reaction force of the driving torque relative to the hydraulic piston 8, Q1 represents an amount of fluid supply from the hydraulic passage 1*d* to the advancing-side hydraulic chamber 14, Q2 represents an amount of leakage from the advancing-side hydraulic chamber 14 to the delaying-side hydraulic chamber 12, and Q3 represents an amount of leakage from the delaying-side hydraulic chamber 12 to the outside.

Preferably, the hydraulic pressure P2 in the delaying-side hydraulic chamber 12 is a positive pressure higher than the atmospheric pressure so as to stop the hydraulic piston 8 stably still. This is because P1 is increased as P2 is higher, so that the hydraulic piston 8 is made more stable.

Therefore, the following expression 3 should be established:

$$P2>0 \quad (3)$$

In order to establish the above-mentioned expressions 1 to 3, the opening 23*c* of the sleeve 23 is slightly opened to the fluid supply side and the opening 23*b* is closed by means of the spool 24.

As described before, the relationship between the clearances C and D in FIG. 2 is set to be C>D. Consequently, in the case of C=0 which is the moment when the opening 23*c* connects the fluid pump 13 with the advancing-side hydraulic chamber 14, the clearance D at the opening 23*d* is less than zero, that is, D<0 (i.e., the larger-diameter portion 24*b* of the spool 24 overlaps with the opening 23*b* of the sleeve 23, thereby shutting off communication between the hydraulic release passage 15*b* and the hydraulic passage 1*a*). When the control circuit 9 controls the clearance C so as to drive the spool 24 in the range C–D, D<0 can be constantly maintained.

That is to say, when the clearances are controlled by the control valve 10 in the above-described manner, fluid can be supplied to the advancing-side hydraulic chamber 14 while discharge of fluid from the delaying-side hydraulic chamber 12 through the opening 23*b* can be shut off, to thereby establish the foregoing expressions 1 to 3.

Therefore, the hydraulic piston 8 can be stably retained at a desired position by establishing the positional relationship between the larger-diameter portions of the spool 24 and the openings of the sleeve 23 to provide the above-described clearances, and by controlling the position of the spool 24. Thus, the valve timing can be reliably maintained at a desired timing.

With the structure and function of the valve timing control device according to the present invention described above, when both the two hydraulic chambers are filled with fluid and the gear is retained at a desired position, the fluid rate control means supplies fluid of a predetermined rate to the advancing-side hydraulic chamber and stops supplying fluid to and discharging fluid from the delaying-side hydraulic chamber.

As a result, when the camshaft-side member is retained at a desired position relative to the crank- shaft-side member, movement of the gear toward the advancing-side hydraulic chamber owing to the driving-torque reaction force of the camshaft-side member can be reduced. Therefore, the gear can be stably retained at the desired position, and the valve timing can be reliably maintained at a desired timing.

What is claimed is:

1. A valve timing control device comprising:

a cylindrical gear having splines formed on the inner and outer peripheries thereof, said splines formed on at least one of inner and outer peripheries thereof being helical, said gear being engaged between a crankshaft-side member and a camshaft-side member so as to transmit rotation of the crankshaft-side member to the camshaft-side member;

gear driving means for moving said gear in the axial direction by a hydraulic pressure, said driving means including an advancing-side hydraulic chamber for rotating said camshaft-side member relative to said crankshaft-side member to an advancing side, and a delaying-side hydraulic chamber for rotating said camshaft-side member relative to said crankshaft-side member to a delaying side; and fluid rate control means for supplying fluid to said advancing-side hydraulic chamber and discharging fluid from said delaying-side hydraulic chamber when said camshaft-side member is rotated relative to said crankshaft-side member to the advancing side, for supplying fluid to said delaying-side hydraulic chamber and discharging fluid from said advancing-side hydraulic chamber when said camshaft-side member is rotated relative to said crankshaft-side member to the delaying side, and for supplying fluid to fill both said hydraulic chambers when said camshaft-side member is retained at a desired position relative to said crankshaft-side member, said fluid rate control means serving to supply fluid of a predetermined rate to said advancing-side hydraulic chamber and substantially stop discharging fluid from said delaying-side hydraulic chamber when said camshaft-side member is retained at the desired position relative to said crankshaft-side member.

2. A valve timing control device according to claim 1, wherein said fluid rate control means comprise a control valve including a yoke of a generally cylindrical shape which is made of a magnetic material, a coil portion, and a rod-like moving core which is slidable in said yoke, a cylindrical sleeve is attached to an end portion of the yoke, and a slidable spool is provided in said sleeve.

3. A valve timing control device according to claim 2, wherein said spool is movable in proportion with a value of electric current supplied to said coil portion, and said electric current value is controlled by a control circuit.

4. A device for adjusting a rotational phase difference between a crankshaft and a camshaft in an internal combustion engine for a vehicle, said device including:

a valve timing control unit including a camshaft-side member connected to said camshaft for rotation therewith, a crankshaft-side member connected to said crankshaft for rotation therewith, a cylindrical gear engaged between said crankshaft-side member and said camshaft-side member to transmit rotation of the crankshaft-side member to the camshaft-side member, said gear having splines formed on the peripheries thereof opposed to the crankshaft-side member and the camshaft-side member, said splines opposed to one of the crankshaft-side member and the camshaft-side member being helical, a hydraulic piston connected to said gear, an advancing-side hydraulic chamber formed on one end face of said hydraulic piston; and a control valve for controlling a rate of fluid supplied to the valve timing control unit, said control valve including:

a spool including passage means formed around itself, said passage means communicating between a delaying-side opening, an advancing-side opening, an inlet opening, an advancing-side discharge port and a delaying-side discharge port such that when said camshaft-side member is rotated relative to said crankshaft-side member to a delaying side, said inlet opening communicates only with said delaying-side opening, and also, said advancing-side opening communicates only with said advancing-side discharge port and when said camshaft-side member is rotated relative to said crankshaft-side member to an advancing side, said inlet opening communicates only with said advancing-side opening, and also, said delaying-side opening communicates only with said delaying-side discharge port, and that when said camshaft-side member is retained at a desired position relative to said crankshaft-side member, said inlet opening communicates only with said advancing-side opening, and also, communication of said delaying-side opening with any of said delaying-side discharge port, said inlet opening, said advancing-side opening and said advancing-side discharge port is shut off, an actuator for driving said spool in one direction, biasing means for biasing said spool in the other direction, and a sleeve in which said spool is slid and moved, said sleeve including a delaying-side opening communicating with a delaying-side hydraulic chamber, an advancing-side opening communicating with said advancing-side hydraulic chamber, an inlet opening where fluid which flows in said control valve and said valve timing control unit is introduced, an advancing-side discharge port where fluid which flows from said advancing-side hydraulic chamber to said control valve is discharged out of the control valve when fluid is supplied to said delaying-side hydraulic chamber, and a delaying-side discharge port where fluid which flows from said delaying-side hydraulic chamber to said control valve is discharged out of the control valve when fluid is supplied to said advancing-side hydraulic chamber.

5. A control valve according to claim 4, wherein said actuator is an electromagnetic valve, said spool is connected to said electromagnetic valve, and slid and moved in said sleeve, said delaying-side discharge port is formed on one end of said spool, said advancing-side discharge port is formed on the other end of said spool, said inlet opening is formed on a central portion of said spool, said delaying-side opening is formed between said delaying-side discharge port and said inlet opening, said advancing-side opening is formed between said advancing-s,de discharge port and said inlet opening, said passage means include a first passage on the one end side of said spool, a third passage on the other end side, and a second passage between said first and third passages, said first to third passages being formed as grooves in the periphery of the pool, when said camshaft-side member is rotated relative to said crankshaft-side member to the delaying side, said inlet opening communicates with said delaying-side opening via said second passage, and also, said advancing-side opening communicates with said advancing-side discharge port via said third passage, when said camshaft-side member is rotated relative to said crankshaft-side member to the advancing side, said inlet opening communicates with said advancing-side opening via said second passage, and also, said delaying-side opening communicates with said delaying-side discharge port via said first passage, when said camshaft-side member is retained at the desired position relative to said crankshaft-side member, said inlet opening communicates with said advancing-side opening via said second passage, and also, communication between said delaying-side opening and said delaying-side discharge port is shut off by a wall between said first and second passages.

6. A rotational phase adjustment device according to claim 4, wherein when said camshaft is retained relative to the crankshaft-side member, said hydraulic piston is applied with a force which moves it toward said advancing-side hydraulic chamber owing to reaction of the driving torque of the camshaft, and this force causes fluid to leak out of the advancing-side hydraulic chamber, and the hydraulic piston is liable to move toward the advancing-side hydraulic chamber, whereas fluid of an amount corresponding to an amount of the leakage is supplied to the advancing-side hydraulic chamber by way of said control valve, and discharge of fluid from said delaying-side hydraulic chamber via the control valve is stopped.

7. A device for adjusting a rotational phase difference between a crankshaft and a camshaft for transmitting forces to intake and exhaust valves in an internal combustion engine for a vehicle, including a valve timing control unit, a control valve for controlling a rate of fluid supplied to the valve timing control unit, and a hydraulic release passage for releasing into the atmospheric pressure fluid which has flowed through the valve timing control unit and the control valve, said hydraulic release passage having a throttle provided therein, said valve timing control unit comprising:

a camshaft-side member connected to said crankshaft for rotation therewith;

a crankshaft-side member connected to said crankshaft for rotation therewith;

a cylindrical gear engaged between said crankshaft-side member and said camshaft-side member to transmit rotation of the crankshaft-side member to the camshaft-side member, said gear having splines formed on the peripheries thereof opposed to the crankshaft-side member and the camshaft-side member, said splines opposed to one of the crankshaft-side member and the camshaft-side member being helical;

a hydraulic piston connected to said gear;

an advancing-side hydraulic chamber formed on one end face of said hydraulic piston; and a delaying-side hydraulic chamber formed on the other end face of said hydraulic piston.

8. A rotational phase adjustment device according to claim 7, wherein when said camshaft is rotated relative to the crankshaft-side member to the delaying side, an amount of fluid discharged from the advancing-side hydraulic chamber per unit time is restricted by said throttle.

* * * * *